US005357947A

United States Patent [19]

Adler

[11] Patent Number: 5,357,947

[45] Date of Patent: Oct. 25, 1994

[54] FACE MASK

[76] Inventor: Harold A. Adler, 1457 Eastwind Cir., Westlake Village, Calif. 91361

[21] Appl. No.: 929,691

[22] Filed: Aug. 12, 1992

[51] Int. Cl.[5] ..... A62B 18/08

[52] U.S. Cl. ..... 128/201.13; 128/205.27; 128/206.17

[58] Field of Search ..... 128/201.13, 205.27, 128/206.17, 206.19, 206.21

[56] References Cited

U.S. PATENT DOCUMENTS

| | | | |
|---|---|---|---|
| 1,488,970 | 4/1924 | Bell | 128/206.17 |
| 2,284,949 | 6/1942 | Cover | 128/206.19 |
| 2,898,908 | 8/1959 | Sovinsky | 128/206.17 |
| 4,273,119 | 6/1981 | Marchello | 128/201.13 |
| 4,361,146 | 11/1982 | Woicke | 128/206.12 |
| 4,384,577 | 5/1983 | Huber et al. | 128/206.19 |
| 4,573,463 | 3/1986 | Hall | 128/205.24 |
| 4,628,927 | 12/1986 | Ward | 128/206.19 |
| 4,832,017 | 3/1989 | Schnoor | 128/206.12 |
| 4,856,508 | 8/1989 | Tayebi | 128/206.12 |
| 4,945,907 | 8/1990 | Tayebi | 128/206.12 |
| 5,010,594 | 4/1991 | Suzuki et al. | 128/201.13 |
| 5,080,094 | 1/1992 | Tayebi | 128/205.29 |
| 5,094,236 | 3/1992 | Tayebi | 128/206.12 |

*Primary Examiner*—Edgar S. Burr
*Assistant Examiner*—Aaron J. Lewis
*Attorney, Agent, or Firm*—Kelly Bauersfeld & Lowry

[57] ABSTRACT

An improved respiratory face mask is provided for filtering inhaled and exhaled air, while discharging exhaled gases in a manner reducing undesired re-inhalation, and reducing capture and retention of exhaled air within the mask and against the face of the wearer. The face mask comprises a mask base adapted to fit in close conformance over a person's nose and mouth, in combination with a generally cup-shaped receiver formed from a porous filter material and carried by the mask base to define a rearwardly open chamber for receiving exhaled gases. In use, exhaled gases flow with minimal resistance to the receiver chamber, at a location spaced forwardly from the person's face, for discharge through the substantial surface area of the receiver material to the surrounding environment.

15 Claims, 1 Drawing Sheet

FIG. 1
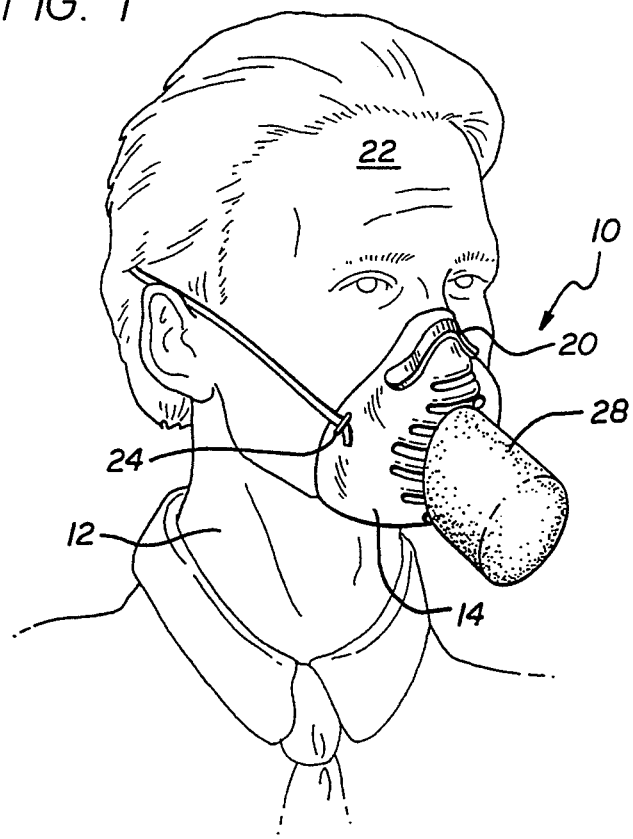
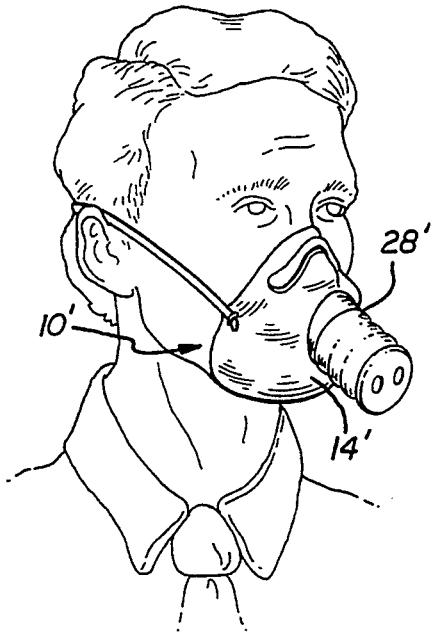
FIG. 4
FIG. 2
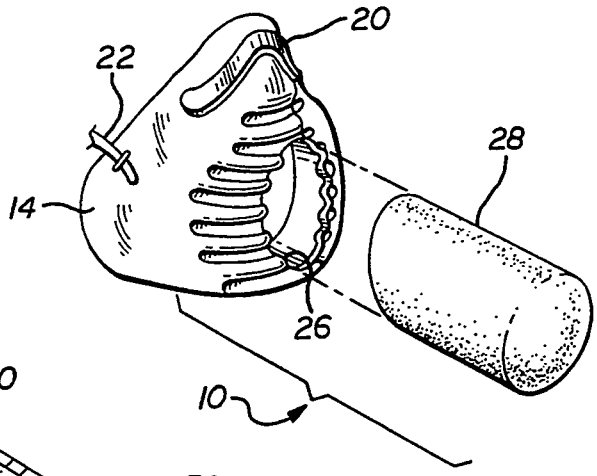
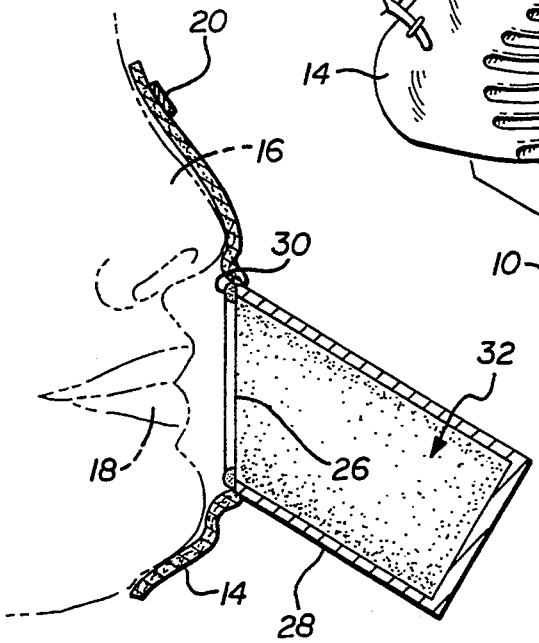
FIG. 3

FACE MASK

BACKGROUND OF THE INVENTION

This invention relates generally to improvements in respiratory face masks of the type worn over a person's nose and mouth to filter inhaled and exhaled air. More particularly, this invention relates to an improved face mask designed for substantially minimizing re-inhalation of exhaled gases.

A wide variety of respiratory face mask constructions are known in the art. In general terms, such face masks comprise a finely porous filter material adapted to be worn over a person's nose and mouth to filter inhaled and exhaled air, particularly for purposes of removing airborne particulate and contaminants. Available face masks are constructed from a variety of controlled porosity filter materials including, for example, paper based and/or plastic fiber materials, foam materials and the like. In some designs, the filter material is provided in a contoured, generally shell-shaped configuration for mounting over the person's nose and mouth by means of an elastic strap. In another form, the filter material is wrapped over the nose and mouth in a manner similar to a scarf.

Respiratory face masks of the general type described above are used extensively in a wide variety of different applications. For example, face masks have been used for many years by medical and dental personnel to minimize or eliminate transfer of infectious disease from or to the patient during treatment. These types of face masks are also used in a wide range of industrial applications to prevent inhalation of harmful substances such as paint particles and other particulate contaminants. In recent years, face masks have been used with increasing frequency by individuals suffering from respiratory allergies and/or other respiratory disfunction to reduce inhalation of plant pollens.

In the past, a preferred face mask construction has generally required a close anatomical fit between the filter material and the facial contours of the person's nose and mouth to minimize leakage around the edges of the mask during inhalation and exhalation. As a result, a widely used prior art face mask has typically provided a close-fitting construction as exemplified by a disposable contoured mask of the type marketed by Minnesota Mining and Manufacturing Company, of St. Paul, Minn., under the model designation 1942F. Unfortunately, in close-fitting masks of this type, the small pore size and resultant reduced porosity of the filter material tends to both reflect the exhaled gas onto the face of the wearer, and reduce the velocity of the exhaled gases sufficiently that the interior of the face mask is often enveloped by the exhaled gas, which includes a high proportion of relatively warm carbon dioxide and water vapor under pressure. This warm moisture saturated air is thereupon held in close proximity to the facial skin of the mask wearer, and is directly re-inhaled through the nose and mouth. As a result, a high proportion of the exhaled gasses are simply re-inhaled, resulting in significant impairment of breathing comfort. In addition, the high content of water vapor present in the exhaled gas also results in repeated and continued fogging of any protective or corrective eyeglasses that may be worn, thereby effectively obscuring vision.

The present invention provides a significant improvement in the construction of a simple respiratory face mask, particularly with respect to a relatively simple yet highly effective face mask construction which substantially reduces re-inhalation of exhaled gases, and further which relieves the wearer of the discomfort of warm moist exhaled air trapped against the facial skin.

SUMMARY OF THE INVENTION

In accordance with the invention, an improved respiratory face mask is provided to fit over the nose and mouth of a person. The face mask includes porous filter materials for filtering inhaled and exhaled air. The face mask geometry defines a forwardly protruding chamber for receiving exhaled gases with minimal flow resistance, and for filtered passage of the exhaled gases through a substantial surface area of filter material to the surrounding environment. This substantial mask surface area additionally minimizes resistance to the passage of fresh room air to the nose and mouth of the wearer. With this construction, re-inhalation of exhaled gases is minimized and availability of fresh room air is maximized.

In a preferred form, the face mask of the present invention includes a contoured mask base formed from a fibrous filter material to have a shell-shaped configuration adapted to fit over a person's nose and mouth in close conformance with facial contours. An elastic strap has opposite ends connected to the opposite sides of the mask base, whereby the strap can be placed about the person's head to retain the mask base in a position over the person's nose and mouth.

A central region of the mask base includes a relatively large opening formed substantially directly in front of the person's nose and mouth, when the face mask is worn. This opening accommodates forward flow of exhaled gases, with minimal flow resistance, to a location spaced forwardly from the face mask. In this regard, the exhaled gases are discharged within the face mask directly into a receiver chamber formed within a generally cup-shaped receiver having its open end mounted onto the mask base at the peripheral margin of the mask base opening.

The receiver chamber has a sufficient volume to receive a substantial portion of an exhaled breath with minimal backflow of exhaled gases to the person's nose and mouth. In this regard, in a preferred construction, the cup-shaped receiver is formed from a porous filter material having a relative porosity which is substantially greater than the porosity of the face mask filter material. In addition, the preferred receiver chamber has a diametric size of at least about two inches, and an axial dimension of at least about three inches. In use, with this construction, exhaled gases are discharged through the substantial surface area of the receiver material in a forward direction as well as a radially outward direction, with a significant proportion of the exhaled gases being discharged at a location spaced substantially forward from the person's nose and mouth. Re-inhalation of exhaled gases is thus minimized, while the air within and immediately outside of the chamber available for inhalation is substantially normal room air in terms of temperature and content.

Other features and advantages of the present invention will become apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view illustrating a person wearing an improved respiratory face mask embodying the novel features of the invention;

FIG. 2 is an exploded perspective view illustrating assembly of components forming the improved face mask;

FIG. 3 is an enlarged vertical sectional view illustrating the face mask as worn over a person's nose and mouth; and FIG. 4 is a perspective view illustrating a person wearing an alternative form of the invention.

DETAILED DESCRIPTION OF THE PREFERRED EMBODIMENTS

As shown in the exemplary drawings, an improved face mask referred to generally by the reference numeral 10 is provided to fit over the nose and mouth of a person 12 as viewed in FIG. 1. The face mask 10 is designed for efficient filtration of inhaled air thereby preventing respiratory ingestion of undesired airborne particulate contaminants. In accordance with the invention, the improved face mask 10 is further designed for efficiently discharging exhaled gases in a manner which minimizes undesirable re-inhalation and equally undesirable prolonged proximity and contact of warm and moist exhaled gas with the wearer's facial skin.

As shown in FIGS. 1–3, in accordance with a preferred embodiment of the invention, the improved face mask 10 comprises a contoured mask base 14 having a shell-shaped geometry adapted to fit in close conformance with facial contours in a position covering the person's nose 16 and mouth 18. The preferred mask base 14 is constructed from a conventional filter material, such as a fiber-based mask material of a type well known to persons skilled in the art. A shaped nose clip 20 may be provided for improved conformance of the mask base contour with the bridge region of the person's nose 16. A simple elastic strap or band 22 has opposite ends secured by staples 24 or the like to the opposite side margins of the mask base 14, whereby the strap 22 can be positioned behind the person's head for securely supporting and retaining the mask base in place. In this position, a peripheral margin of the mask base 14 effectively seats and seals with the wearer's facial skin, such that inhaled air and exhaled gases are confined to pass through the mask material, as will be described.

A relatively large central opening 26 is formed in the mask base, generally in a position disposed immediately in front of the person's nose and mouth when the mask is worn. This opening 26 thus permits exhaled gases to be discharged substantially directly, and with minimal flow resistance, to a position disposed forwardly from the mask base 14.

A generally cup-shaped receiver 28 has, in the preferred form, a generally tubular shape conforming with the diametric size of the central opening 26 in the mask base 14. The receiver 28 has one open end which is securely mounted to the mask face at the peripheral margin of the central opening 26, as by means of an annular adhesive bead 30 (FIG. 3). In this position, the cup-shaped receiver defines a rearwardly open chamber 32 of substantial volume for direct and substantially unrestricted reception of exhaled gases passing through the central opening 26. The receiver 28 is shown to tilt forwardly and downwardly from the mask base, to prevent or minimize obscuring the vision of a person wearing the mask.

Each exhaled breath from the person 12 thus passes with minimal resistance, and substantially at a normal discharge direction and velocity, into the receiver chamber 32. Importantly, the receiver 28 is formed at least in part and preferably in its entirety from a porous filter material such as an open cell foam having a porosity which is substantially greater than the porosity of the mask base 14. With this construction, the exhaled breath is discharged with minimal flow resistance and at normal exhalation velocity through the receiver filter material. This discharge passage of the exhaled gas to the surrounding environment occurs through the substantial surface area of the cup-shaped receiver 28, with a predominant portion being discharged forwardly and radially outwardly and at a location spaced substantially away from the person's nose, mouth and face. The higher porosity of the receiver 28 in combination with the large surface area defined thereby provides for gas discharge flow with little or no pressurization of the volumetric space within the mask. This construction has been found to significantly reduce blow-back or re-inhalation of exhaled gases, and additionally to significantly reduce fogging of eyeglasses attributable to exhaled water vapor. The overall effectiveness of the filter mask and breathing comfort during use are significantly enhanced. After use, the mask can be economically discarded.

While the size and shape of the receiver 28 may vary, a preferred and effective receiver configuration includes a diametric size of at least about two inches, and an axial dimension of at least about three inches. A preferred receiver material has a porosity on the order of about 100 pore. Such relatively porous filter material, in the form of an open cell foam, is available from Coventry Manufacturing Company, Inc., of Baldwin Park, Calif., under the designation Foam Mask 6000.

FIG. 4 illustrates an alternative form of the invention, wherein structural components conforming to those shown and described in FIGS. 1–3 are identified by common primed reference numerals. In this embodiment, a modified mask 10' includes a mask base 14' in combination with a cup-shaped receiver 28' to function in the same manner as previously described with respect to FIGS. 1–3. However, the receiver 28' is modified to a novelty configuration, illustrated in the form of a pig's nose. This novelty configuration has been found to be especially useful when the face mask is worn by medical or dental personnel in the course of treating children. The operation and effectiveness of the improved face mask 10' including the novelty shaped receiver 28', is identical to the face mask shown in FIGS. 1–3.

In a further alternative form of the invention, a mask constructed generally according to FIGS. 1–3 may be provided wherein the mask base and receiver are integrally formed or otherwise formed from the same material. Such construction provides the desired enlarged mask surface area, for efficient exchange of inhaled air and exhaled gases through the mask material, while additionally providing greatly enhanced wearer comfort.

A variety of further modifications and improvements to the improved respiratory face mask shown and described herein will be apparent to those skilled in the art. Accordingly, no limitation on the invention is intended by way of the foregoing description and accompanying drawings, except as set forth in the appended claims.

What is claimed is:

1. A face mask, comprising:

a generally shell-shaped porous mask base having a size and shape to fit generally over the nose and mouth of a person in substantial peripheral conformance with facial contours of the person, said mask base having a relatively large central opening formed therein and defining a peripheral margin extending about said central opening;

means for retaining said mask base in a position over the person's nose and mouth; and a generally cup-shaped receiver formed from a porous filter material and having one open end and an opposite closed end, said receiver being carried on said mask base in a position over said central opening, with said open end of said receiver being joined to said mask base generally at said peripheral margin, said receiver extending forwardly from said mask base to define a rearwardly open receiver chamber for direct reception of gases exhaled by a person wearing the mask, said receiver chamber extending forwardly a substantial distance from said mask base and said closed end of said receiver being spaced a substantial distance forward of said mask base, said receiver chamber defining an open volume for unrestricted passage of exhaled gases into said receiver chamber, and said receiver further defining a substantial porous surface area in addition to said mask base for further passage of exhaled gases from said receiver chamber and through said porous surface area of said receiver to the surrounding environment at a location spaced substantially forwardly from said mask base, said porous surface area of said receiver being substantially greater than the area of said central opening.

2. The face mask of claim 1 wherein said porous mask base is formed from filter material.

3. The face mask of claim 2 wherein at least a portion of said receiver has a porosity substantially greater than the porosity of said mask base.

4. The face mask of claim 1 wherein said generally cup-shaped receiver is proportioned to have the shape of an animal nose.

5. The face mask of claim 1 wherein said receiver chamber has a diametric size of at least about two inches and an axial length of at least about three inches.

6. The face mask of claim 1 wherein said receiver chamber has an axial length of at least about three inches.

7. The face mask of claim 1 wherein said receiver chamber has a diametric size of at least about two inches.

8. The face mask of claim 1 wherein said receiver has a cross sectional size and shape conforming generally to the size and shape of said central opening in said mask base.

9. The face mask of claim 1 wherein said retaining means comprises an elastic strap.

10. A face mask, comprising:

a generally shell-shaped porous mask base having a size and shape to fit generally over a person's nose and mouth in substantial peripheral conformance with facial contours of the person, said mask base having a relatively large central opening formed therein for substantially direct and unrestricted passage of an exhaled breath; and a generally cup-shaped receiver formed from a porous filter material and having one open end and an opposite closed end to define an open-ended receiver chamber, said receiver being carried by said mask base with the open end connected to said mask base generally about the periphery of said central opening and extending therefrom in a forward direction with said closed end being disposed a substantial distance forward of said mask base, whereby said receiver chamber is rearwardly open for direct and unobstructed inflow of the exhaled breath, said receiver chamber protruding forwardly a substantial distance from said mask base, said receiver defining a substantial porous surface area in addition to said mask base for passage of exhaled gases from said receiver chamber to the surrounding environment at a location spaced substantially forwardly from said porous mask base, said porous surface area of said receiver being substantially greater than the area of said central opening.

11. The face mask of claim 10 further including means for retaining said mask base in a position over the person's nose and mouth.

12. The face mask of claim 10 wherein said porous mask base is formed from filter material.

13. The face mask of claim 12 wherein said receiver has a porosity substantially greater than the porosity of said mask base.

14. The face mask of claim 10 wherein said generally cup-shaped receiver is proportioned to have the shape of an animal nose.

15. The face mask of claim 10 wherein said receiver chamber has a diametric size of at least about two inches and an axial length of at least about three inches.

* * * * *